US005113849A

United States Patent [19]

Kuiken et al.

[11] Patent Number: 5,113,849

[45] Date of Patent: May 19, 1992

[54] FINGER EXTENDER

[76] Inventors: Paul A. Kuiken, 104 - 4th St. NW., Aitkin, Minn. 56431; Michael K. Murray, 504-½ Abrams St., Green Bay, Wis. 54309

[21] Appl. No.: 679,254

[22] Filed: Apr. 2, 1991

[51] Int. Cl.[5] ..... A61H 1/02

[52] U.S. Cl. ..... 128/26; 602/21

[58] Field of Search ..... 272/67, 68, 135, 139, 272/143; 128/26, 77, 87 R, 87 A, 89 R; 84/465, 467, 468; D21/198; D24/190, 200

[56] References Cited

U.S. PATENT DOCUMENTS

| | | | |
|---|---|---|---|
| 818,332 | 4/1906 | Anson | 84/468 |
| 867,981 | 10/1907 | Krizek . | |
| 2,108,236 | 2/1938 | Scott . | |
| 4,190,902 | 3/1980 | Rhee | 128/87 R |
| 4,253,660 | 3/1981 | Tiktin . | |
| 4,368,883 | 1/1983 | Tiktin . | |
| 4,382,439 | 5/1983 | Shen | 128/77 |
| 4,570,925 | 2/1986 | Kock et al. . | |
| 4,765,608 | 8/1988 | Bonasera . | |
| 4,815,729 | 3/1989 | Stefanski . | |
| 4,830,360 | 5/1989 | Carr, Jr. . | |

FOREIGN PATENT DOCUMENTS

| | | | |
|---|---|---|---|
| 20724 | 4/1919 | France | 128/26 |

*Primary Examiner*—Richard J. Apley
*Assistant Examiner*—Susan L. Weinhoffer
*Attorney, Agent, or Firm*—Haugen and Nikolai

[57] ABSTRACT

A device for strengthening extensor muscle groups of the forearms and hand consisting of a leaf spring with a generally planar portion and an integrally formed arcuate portion containing a plurality of tines. The user straps the device onto the posterior surface of the forearm and inserts his/her fingers into the finger sleeves resulting in a closed fist position of the hand. The user uses the exterior muscle group to straighten his/her hand against the spring force of the device. The device is intended as a therapeutic implement for individuals with carpal tunnel syndrome, elbow and wrist tendinitis and similar injuries or for general muscle strengthening.

8 Claims, 2 Drawing Sheets

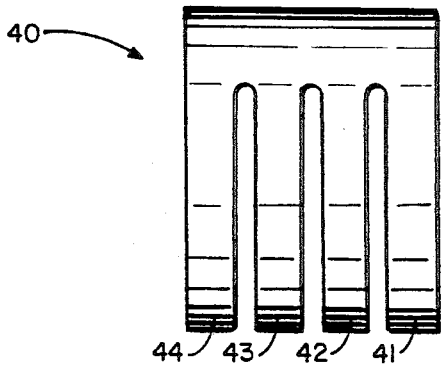
FIG. 4
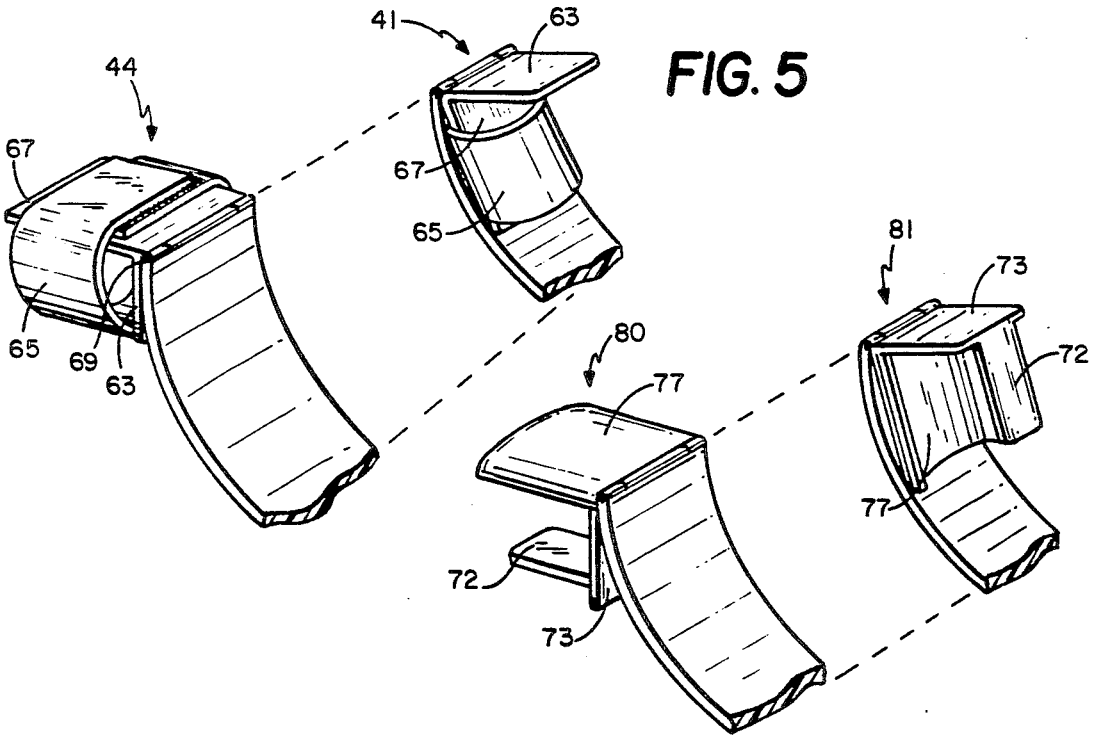
FIG. 5
FIG. 6

FINGER EXTENDER

BACKGROUND OF THE INVENTION

I. Field of the Invention

This invention relates generally to device for treating tendinitis, carpal tunnel syndrome and more particularly to a device for strengthening the extensor muscles in the forearm and hand which operate to extend or straighten the fingers and wrist. The invention works to achieve a balance between the extensor and flexor muscle groups of the forearm and hand.

II. Description of the Prior Art

Previous devices for exercising the muscles of the hand and forearm have generally been limited to the flexor muscles which operate to close the fingers and wrist to form a fist. For example, U.S. Pat. No. 2,108,236 to Scott describes a mitten or strap arrangement which resists the ability to form the hand into a fist. Likewise, U.S. Pat. No. 4,830,360 to Carr teaches an orthopedic exercise glove containing resilient biased tubes which resist the forming of the hand into a fist.

Similar devices exert opposing forces to finger movement. See for example, Stefanski, U.S. Pat. No. 4,815,729, which utilizes an adjustable resilient elastomeric band surrounding the user's fingers. The fingers exert opposing forces to the band. Krizek, U.S. Pat. No. 867,981, pertains to a device which straps onto the user's arm. A plurality of resilient bands which create tension connect the wrist strap to a plurality of loops in which the user inserts his or her fingers. Each resilient band is selectively adjustable for tension on its respective finger. A similar device can be found in the Bonasera U.S. Pat. No. 4,765,608. This finger exerciser straps on to the user's wrist and contains an arcuate-shaped tined section which wraps around the other hand. Fingers are strapped to the tines with a resilient component. The individual resilient components are selectively adjustable for different tensions. It is primarily designed to fit on the wrists and fingers of a musician so as to develop the hand and fingers for better speed and coordination in playing instruments such as a guitar or keyboard.

An alternative device can be found in Kock, U.S. Pat. No. 4,570,925. This device consists of a frame structure. The user grasps the device utilizing a hand gripping squeezing action, a forearm twisting action or a wrist casting action.

Tiktin's U.S. Pat. Nos. 4,253,660 and 4,368,883 are devices which operate to provide resistive forces to the extensor muscles as in the present invention. Weights are suspended from the fingers of the user's glove causing the fingers to close. Opening the hand, utilizing the extensor muscles, is resisted by the weights. This device strengthens the extensor muscles by attaching a plurality of weights at a plurality of locations. The user must contend with any swinging or pendulum motion of the hanging weights.

What is needed is a simple, easy to use device for strengthening the extensor muscle group. The extensor muscle group includes the extensor digiti minimi, extensor indicis, extensor digitorum, extensor pollicis brevis, extensor carpi ulnaris, extensor carpi radialis brevis and their respective tendons. A device which also strengthens the flexor muscles is not necessary because flexor muscles are used frequently in daily gripping activities. The device is intended for long term, life time use by individuals who suffer from carpal tunnel syndrome, tendinitis of the elbow and wrist or similar injuries/-weaknesses.

SUMMARY OF THE INVENTION

The primary object of the invention is to provide a therapeutic device for strengthening the extensor muscle group of the fingers and wrist.

Another object is to balance the extensor and flexor muscle groups of the forearm and hand.

Still another object is to provide a device which is simple, easy to use, and intended for long term or life time use.

Yet another object is to provide a device standard in size with minimal adjustment for proper user fit.

Another object is to provide an extensor muscle exercise device to be used by any individual desiring to improve muscle strength in addition to use as a therapeutic device.

The foregoing objects and advantages are attained by providing a simple leaf-spring device to strap onto one's forearm and hand. It includes a plurality of tines, each having a finger-receiving attachment, an arcuate portion which curves over the user's closed fist and a generally planar portion to strap onto one's forearm. The leaf spring may be made from spring metal or a fiber reinforced resin having desired memory properties. The device is pre-formed so as to have a generally planar portion and integrally formed arcuate portion. The arcuate portion is segmented to so as to define plural tines at the ends of which are the finger sleeves for receiving the fingers of the user. The resistive force of the spring works against the muscles needed to open the hand by extending the fingers. The user opposes the extensor muscle group when straightening the hand out against the spring force of the device. Use of the device will provide relief for those suffering from carpal tunnel syndrome, tendinitis of the elbow or wrist and other similar injuries.

Further objects, features and advantages of this invention will be readily apparent from the drawings and detailed description of the preferred embodiment in which like numerals in the several views refer to in the corresponding parts.

BRIEF DESCRIPTION OF THE DRAWINGS

FIG. 4 is an end view of the exercise device;

FIG. 5 is a fragmentary view showing one type of finger sleeve; and

FIG. 6 is a fragmentary view of an alternate finger sleeve.

DESCRIPTION OF THE PREFERRED EMBODIMENT

Figure 1:
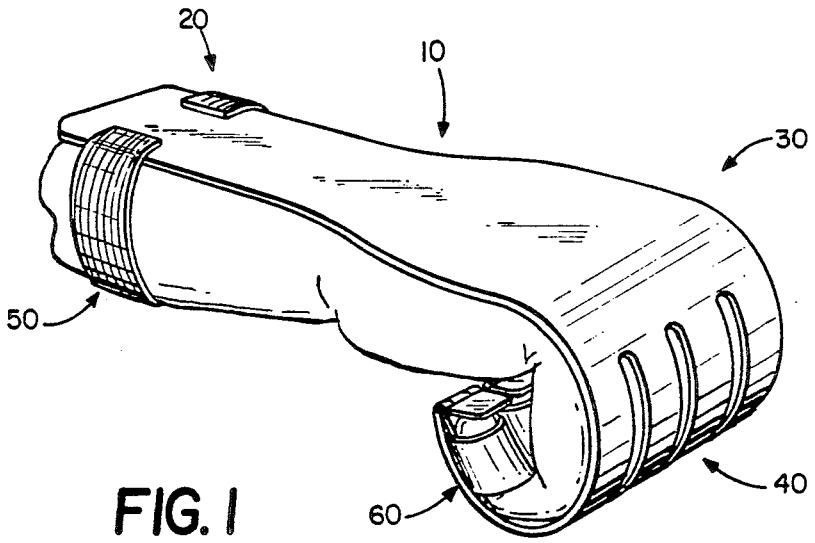
FIG. 1 is a perspective view of a user's forearm and hand with the device of the present invention in place.

The device is shown generally in FIG. 1. It is seen to comprise a leaf spring 10 with a generally planar portion 20 and an integrally formed arcuate portion 30. The device is a standard size selectably adjustable for the individual user's forearm and fingers. The generally planar portion 10 is adapted to be secured to the user's outer forearm with flexible strap 50. The arcuate portion 30 curves around the back of the hand and over the user's fingers naturally tending to cause the fingers to form a fist. The arcuate portion is segmented so as to define plural tines 41–44. Affixed to the ends of the tines are finger attachments 60 which will be described in greater detail below.

Figure 2:
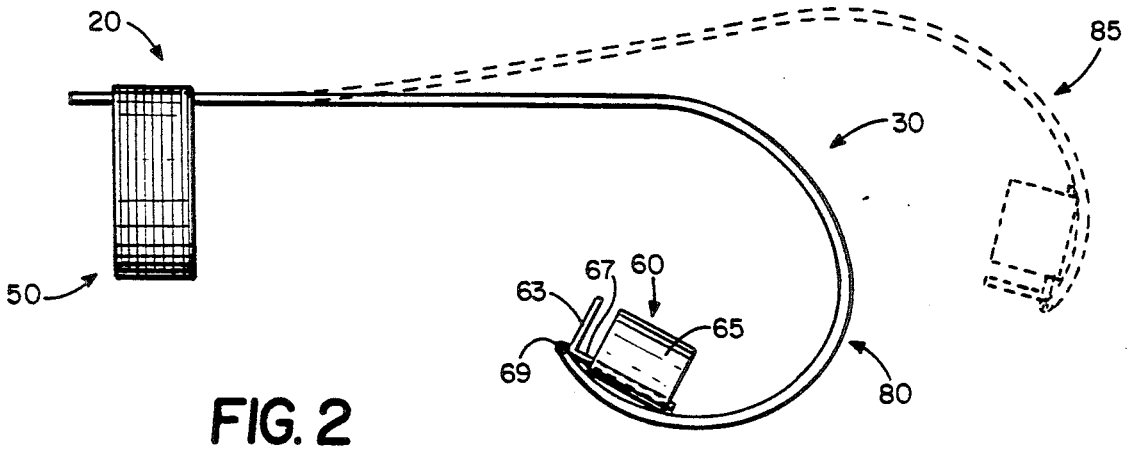
FIG. 2 is a side view of the device of FIG. 1 shown in a relaxed and flexed disposition.

The device is preferably made out of material such as spring steel or a fiber-reinforced resin that will ideally resist a stress of 3-5 psi. This strength characteristic ensures appropriate resilience and ensures a suitable material for repetitive long term usage of at least 10,000 flexures. FIG. 2 shows the device in solid line form in a non-flexed position 80 and by a dashed line in a flexed position 85.

Figure 3:
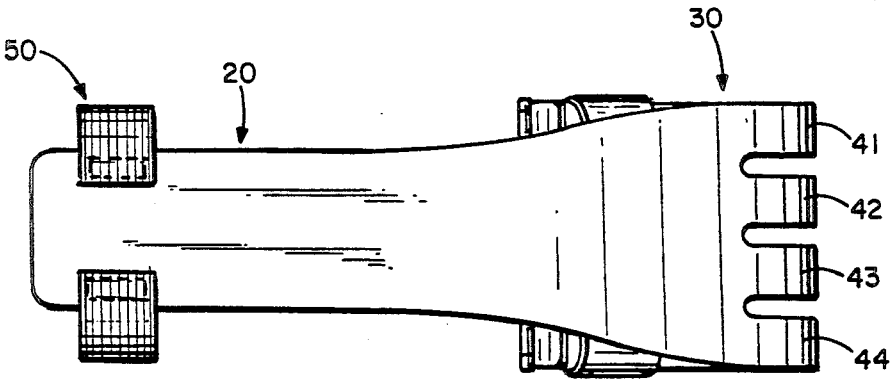
FIG. 3 is a top plan view of the exercise device.

As mentioned, the extensor muscle exercise device's arcuate portion 30 is segmented into a plurality of tines 41–44, one for each finger as shown in FIGS. 1, 3 and 4. The arcuate portion 30 extends from the planer portion 20 to a somewhat greater width at 30 as shown in FIG. 1 and FIG. 3. The tapering is more conducive for appropriate selective positioning of the planar portion to the individual user; but it should be understood that a workable device can be constructed without providing the taper from a wider arcuate portion 30 to a narrow planar portion 20.

The strap 50 located on the planar portion 20 for securing the device to the forearm is ideally made out of VELCRO® hook and loop material but any suitable strap arrangement allowing adjustment of length can be used.

The finger attachments 60 are affixed near the end portions of tines 41–44. The finger attachments, as shown in FIG. 5, are hinged sleeves for receiving the user's fingers. The sleeve is hinged at 69. The sleeve has a base plate 67 and an end plate 63. The finger is secured to the base plate by strap 65, preferably of VELCRO® brand of hook and loop material. The strap 65, however, can be made out of any other suitable material allowing adjustment to individual fingers such as a loop or band of elastomeric material.

An alternative finger attachment arrangement is the one shown in FIG. 6. This attachment has a base plate 77 and an end plate 73. In place of a strap, this finger attachment has an upper plate 72 located opposite the base plate 77. Additionally, base plate 77 and upper plate 72 may have a slight arcuate shape for receiving a finger. The hinged arrangement provides for ease in securing the device on the user's fingers. The hinged arrangement also allows movement of each individual finger because of the different flexing capabilities and strength of each individual finger.

The sleeves 65 act to secure the fingers to the appropriate tine and serve to assure proper alignment of fingers to their respective tine during operation of the device. In operation, the user works to open the hand and exerts a force in opposition to the device by contracting the extensor muscle group, which includes the extensor digiti minimi, extensor indicis, extensor digitorum, extensor pollicis brevis, extensor carpi ulnaris and extensor carpi radialis brevis muscles of the hand and forearm. As such, close tolerance between the user's fingers and the devices' finger receiving sleeves is not necessary for optimal operation. Ideally, the sleeves 65, like the main structure, are of a standard size that can accommodate a variety of user finger sizes.

Turning now to the operation of the device, the user forms a fist shape, inserts his or her fingers into the finger sleeve attachments 60 located at the end of the tines 41–44 and straps the device to the forearm with strap 50. The user may then adjust the device, via the straps 50 or sleeves 72 to fit his or her forearm and hand. From the position 80, shown in FIG. 2, the user flexes the hand and wrist to open the fingers to position 85. The device resists the flexation motion thereby working against the extensor muscle group to strengthen the extensor muscles. The user may typically perform 20 repetitions or flexes per hand and wrist, say, three times per week or as otherwise directed by a health professional. It has been found that performing this exercise over time tends to relieve the occurrence of pain and discomfort due to tendinitis and/or carpel tunnel syndrome.

While the above provides a full and complete disclosure of the preferred embodiments of the present invention, various modifications, alternative constructions, and equivalents will occur to those skilled in the art given the benefit of this disclosure. Thus, the invention is not limited to the specific embodiments described herein, but as defined by the appended claims.

What is claimed is:

1. A device for exercising an extensor muscle group comprising:

(a) a leaf spring having a generally planar portion and an integrally formed arcuate portion including a plurality of tines;

(b) means for releasably securing said planar portion to the anterior surface of a user's forearm with said arcuate portion surrounding the user's fist; and (c) tubular, finger tip receiving sleeve portions hinged to said tines, said sleeve portions each having a base plate hinged to a respective tine, an end plate located opposite the hinge and an upper plate extending from the end plate in parallel, spaced relation to the base plate.

2. The device as in claim 1 wherein said leaf spring is formed from a spring steel.

3. The device as in claim 1 wherein said leaf spring is formed from a fiber-reinforced resin.

4. The device as in claim 1 wherein said means for releasably securing said planar portion to the forearm comprises an adjustable strap.

5. The device as in claim 4 wherein the adjustable strap is hook and loop pile material.

6. A device for exercising an extensor muscle group, comprising:

(a) a leaf spring having a generally planar portion and an integrally formed arcuate portion including a plurality of tines;

(b) means for releasably securing said planar portion to the anterior surface of a user's forearm with said arcuate portion surrounding the user's fist; and (c) tubular, finger tip receiving sleeve portions hinged to said tines, each sleeve portion having a base plate with one end thereof hinged to a tine, an end plate extending perpendicular from said base plate at the other end thereof and an adjustable strap attached to the base plate for encircling a finger tip resting on said base plate and abutting said end plate.

7. The device as in claim 6 wherein said adjustable straps are hook and loop pile material.

8. The device as in claim 6 wherein said adjustable straps are elastomeric material.

* * * * *